US010531715B2

(12) United States Patent
Ng

(10) Patent No.: US 10,531,715 B2
(45) Date of Patent: Jan. 14, 2020

(54) BEAD TRAY

(71) Applicant: Choon's Design LLC, Wixom, MI (US)

(72) Inventor: Cheong Choon Ng, Novi, MI (US)

(73) Assignee: Choon's Design LLC, Wixom, MI (US)

( * ) Notice: Subject to any disclaimer, the term of this patent is extended or adjusted under 35 U.S.C. 154(b) by 240 days.

(21) Appl. No.: 15/405,751

(22) Filed: Jan. 13, 2017

(65) Prior Publication Data

US 2017/0196319 A1 Jul. 13, 2017

Related U.S. Application Data

(60) Provisional application No. 62/278,039, filed on Jan. 13, 2016.

(51) Int. Cl.

| | |
|---|---|
| ***B23P 19/00*** | (2006.01) |
| ***A44C 27/00*** | (2006.01) |
| ***B65D 83/04*** | (2006.01) |

(52) U.S. Cl.
CPC ..... *A44C 27/00* (2013.01); *B65D 83/0481* (2013.01)

(58) Field of Classification Search
CPC ..... B25B 11/00; B23P 11/00; B23P 19/00; B23P 19/04; A44C 27/00
See application file for complete search history.

(56) References Cited

U.S. PATENT DOCUMENTS

| | | | | |
|---|---|---|---|---|
| 3,801,094 | A * | 4/1974 | Treaster | A63F 7/3622 446/168 |
| 5,344,143 | A * | 9/1994 | Yule | A63F 7/3622 273/118 R |
| 6,386,538 | B1 * | 5/2002 | Mejia | A63F 7/3622 273/118 R |
| 6,619,962 | B1 * | 9/2003 | Gubitosi | A63F 7/386 273/118 R |
| 2017/0196319 | A1 * | 7/2017 | Ng | A44C 27/00 |
| 2017/0252660 | A1 * | 9/2017 | Jungco | A63H 19/30 |

* cited by examiner

*Primary Examiner* — Lee D Wilson
(74) *Attorney, Agent, or Firm* — Carlson, Gaskey & Olds, P.C.

(57) ABSTRACT

A disclosed bead tray for holding and sorting beads includes a tray with a contoured bottom surface for orientating beads and guiding the beads from the tray onto a track. The track is disposed between side surfaces that are angled away from the track. The side surfaces are angled such that an end of a string is guided upward toward the track and into an opening of a bead within the track.

6 Claims, 3 Drawing Sheets

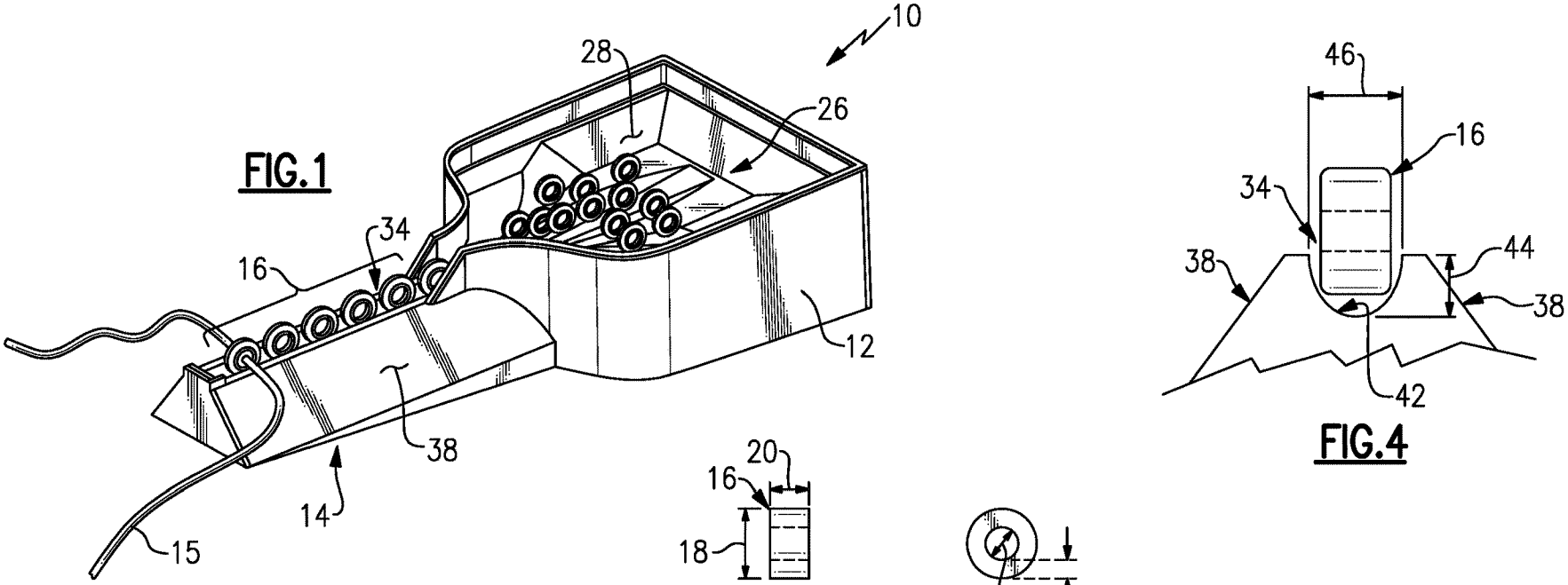
FIG.1
FIG.2A
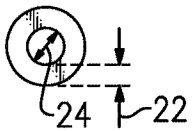
FIG.2B
FIG.4
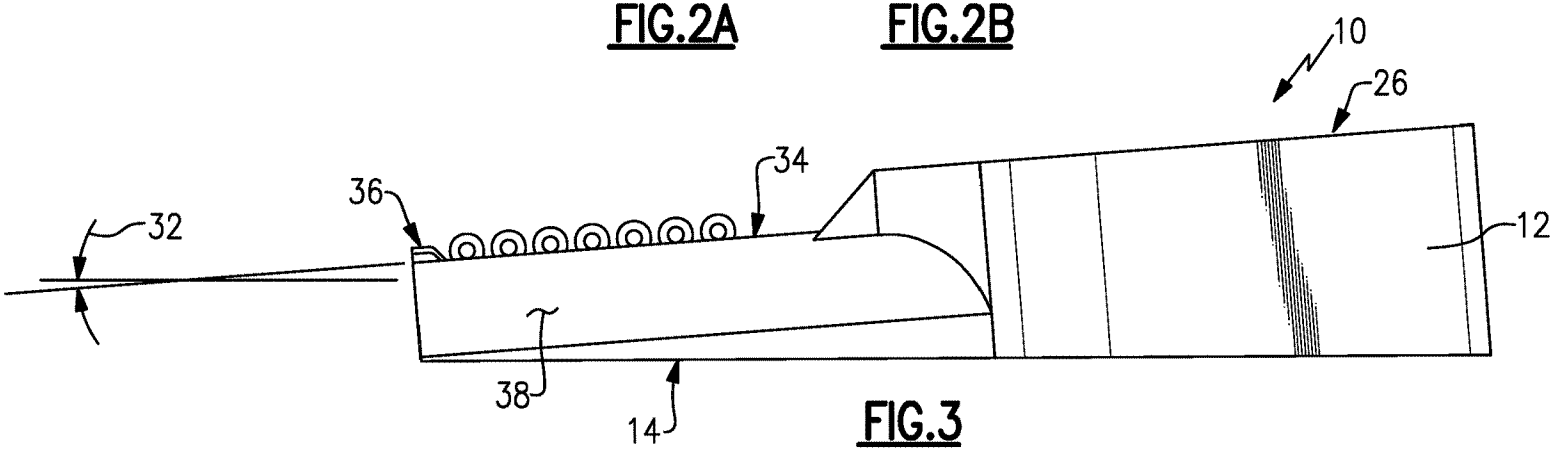
FIG.3

16
24
38
15
14

BEAD TRAY

CROSS REFERENCE TO RELATED APPLICATION

The application claims priority to U.S. Provisional Application No. 62/278,039 which was filed on Jan. 13, 2016.

BACKGROUND

This disclosure generally relates to method and device for threading beads onto a string or thread for creating a beaded item.

Beads are sometimes threaded onto a string or thread to create bracelets, or other beaded items and jewelry. In some instances it is necessary to thread multiple beads onto a single strand of string, thread, wire or elastic. Threading beads onto a string can be tedious and time consuming. Holding a bead in one hand and guiding a string through an opening in the bead with the other takes time, dexterity and patience. In some instances, the time taken to thread beads onto string can detract from the initial excitement and interest in making the beaded item. Moreover, beads are relative small items that can be difficult to organize and maintain in a way that both eases assembly and prevents errant misplacement of beads.

SUMMARY

A disclosed bead tray for holding and sorting beads includes a tray with a contoured bottom surface for orientating beads and guiding the beads from the tray onto a track. The track is disposed between side surfaces that are angled away from the track. The side surfaces are angled such that an end of a string is guided upward toward the track. The track includes depth to set an opening in the bead into alignment with a top of the track and the side surface such that the end of the string is guided upward along the side surface and into the opening of the bead.

Accordingly, the disclosed bead tray aids the task of threading a string onto a bead to improve the experience of creating a beaded item.

These and other features disclosed herein can be best understood from the following specification and drawings, the following of which is a brief description.

BRIEF DESCRIPTION OF THE DRAWINGS

FIG. 1 is a perspective view of an example bead tray embodiment.

FIG. 2A is a front view of an example bead.

FIG. 2B is a side view of the example bead.

FIG. 3 is a side view of the example bead tray.

FIG. 4 is a sectional view of a bead within a track portion of the example bead tray.

DETAILED DESCRIPTION

Figure 5:
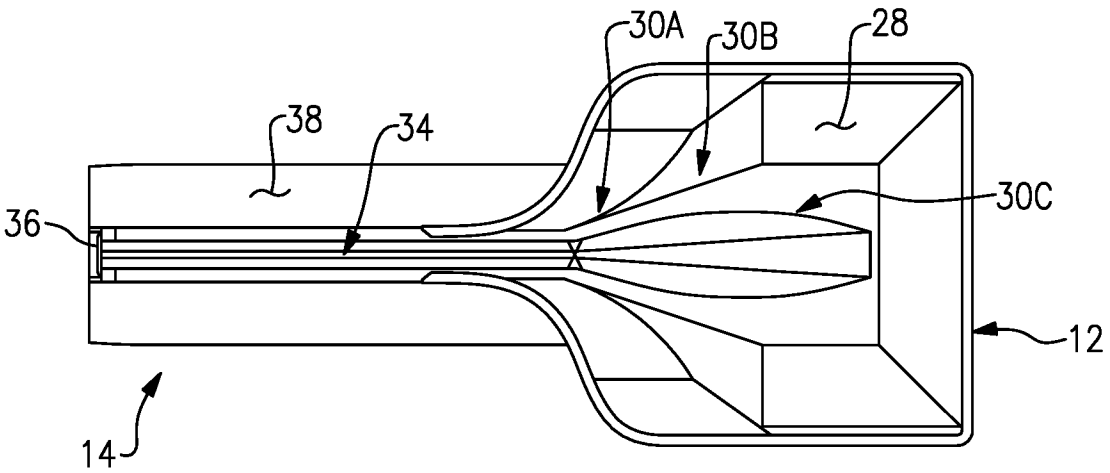
FIG. 5 is a top view of the example bead tray.

Referring to FIG. 1, a bead sorting tray 10 is schematically illustrated and includes a tray portion 12 for holding beads 16 and a loading portion 14. The tray 12 includes a bin 26 for holding a plurality of beads 16. The bin 26 leads to the loader 14. The loader 14 includes a track portion 34 where beads 16 are fed from the bin 26 and aligned for easy threading of a thread, string or other elongated members schematically illustrated at 15. The track 34 provides for the bead 16 to be aligned and orientated such that openings through the bead 16 are disposed transverse to the track 34 to provide for easy threading. The bin 26 includes a bottom surface 28 that is contoured to direct the beads into the track 34.

The disclosed embodiment is a single unitary structure and the term "portion" is used to indicate parts of the disclosed embodiment. It should be understood that it is specifically with the contemplation of this disclosure that the disclosed bead tray could be made as a single structure or from any different structures and parts jointed together.

Referring to FIGS. 2A and 2B with continued reference to FIG. 1, each of the beads 16 includes an outer diameter 18, an inner diameter 24 and a width 20. Each of the beads 16 also includes a thickness 22 between the outer diameter 18 and the inner diameter 24.

Referring to FIGS. 3 and 4 with continued reference to FIG. 1, the example track 34 includes a profile that aligns the inner diameter 24 with side surface 38 of the loading portion 14. The track 34 includes a bottom surface 42 that is contoured to hold the bead 16 in an upright position as is illustrated in FIG. 3. The side surfaces 38 are angled to align the string member 15 with the inner diameter 24 of each of the beads 16. In this example, the track 34 includes a width 46 and a depth 44. The depth 44 and width 46 work in concert to align the beads 16 such that the inner diameter 24 is substantially aligned with the sides 38.

The example track 34 is angled downwardly at an angle 32 such that the beads 16 will roll down the track 24 against an end lip 36. The bin 26 includes the bottom surface 28 that directs the beads 16 into the loader 14. The loader 14 includes the track 34 angled downwardly at the angle 32 such that the beads 16 are directed into the track 34 and orientated relative to the side surfaces 38.

The example tray track 34 includes the width 46 and the depth 44 that properly aligns bead 16 of a given size with the sides 38 such that the inner diameter 24 is aligned with the sides 38. However, the width 46, depth 44, bottom surface profile 42 and angle 32 can be tailored to accommodate any size of beads 16.

Figure 6:
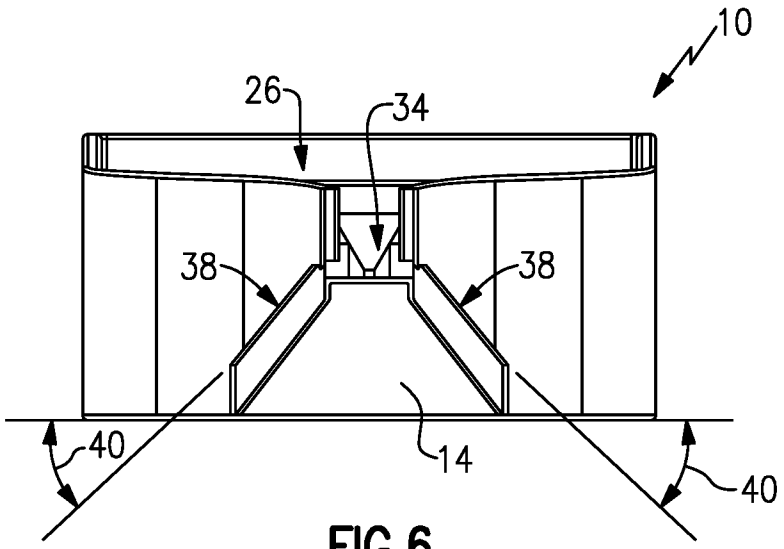
FIG. 6 is front view of the example bead tray.

Referring to FIGS. 5 and 6 with continued reference to FIGS. 1-4, the example bead tray 10 includes the bin 28 that includes a bottom surface 28. The bottom surface 28 includes contours 30*a*, 30*b*, 30*c* that direct the beads into the track 34. The contours 30*a-c* are arranged to direct beads into the tracks 34 in a manner such that they are orientated in an upright manner. In other words, each of the beads 16 are orientated such that the inner diameter or opening through each of the beads 16 extends across the track 34. Moreover, the beads 16 are orientated such that the outer diameter allows them to roll downward through the track 34 and be stopped against the lip 36.

Referring to FIG. 6 with continued reference to FIG. 3, the example loader portion 14 includes the track 34 with angled side surfaces 38. The angled side surfaces 38 are disposed at an angle indicated at 40 that provides for the easy installation or threading of a thread string or other elongated member through the inner diameter of a bead supported within the track 34.

Figures 7A, 7B, 7C, 7D:
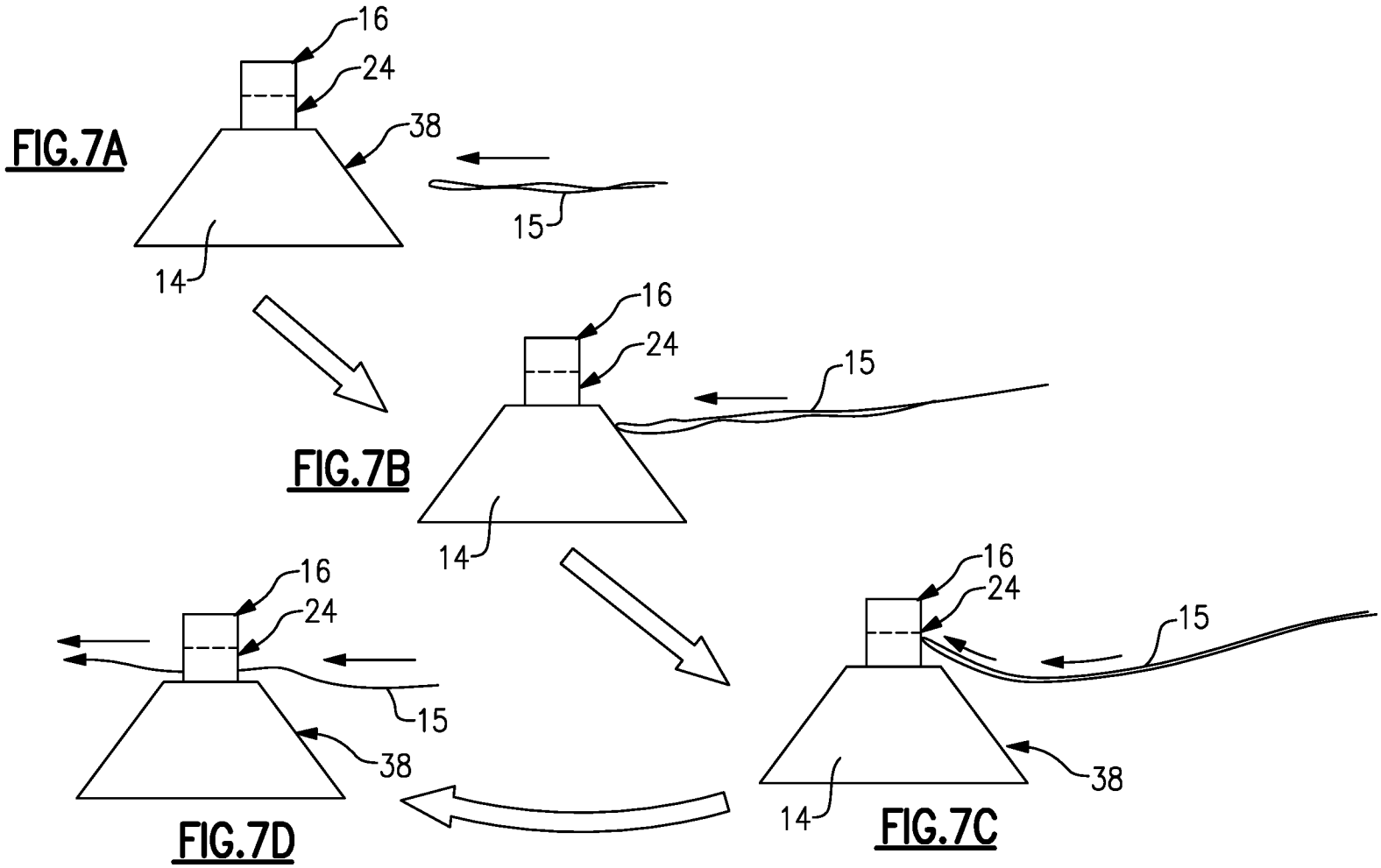
FIG. 7A is a schematic view of first step in a disclosed method of inserting a string into a bead.
FIG. 7B is a schematic view of another step in a disclosed method of inserting a string into a bead.
FIG. 7C is a schematic view of yet another step in a disclosed method of inserting a string into a bead.
FIG. 7D is a schematic view of an additional step in a disclosed method of inserting a string into a bead.

Referring to FIG. 7A-7D, the side surfaces 38 provide for alignment of the string or thread material with the inner diameter 24 of a bead 16. In this example, an end of a thread 15 is directed towards the loader portion 14 and impacts the side surface 38 as is illustrated in FIG. 7B. The angle 40 of the side surface 38 orientates the threaded member 15 such that it proceeds upward along the side surface 38 towards the bead 16 within the track 34. The angle 38 is provided such that the thread 15 guides along the side surface 38 and is directed into the inner diameter 24 of the bead 16 as is shown in FIG. 7C. Accordingly, the threaded member 15 will extend through the inner diameter 24 of the bead 16 as shown in FIG. 7D and enable the bead 16 to be removed from the track 34, where another bead 16 is loaded into place for assembly onto the thread 15.

Accordingly, the example bead tray provides not only for organization of the beads but also eases assembly and the creation of a beaded item.

Although an example embodiment has been disclosed, a worker of ordinary skill in this art would recognize that certain modifications would come within the scope of this disclosure. For that reason, the following claims should be studied to determine the scope and content of this invention.

What is claimed is:

1. A device for holding and sorting beads, the device comprising:

a tray portion including a contoured surface for orientating beads for exiting the tray portion and sides surrounding the contoured surface; and a track portion receiving beads from the tray and positioning the received beads relative to guiding surfaces on either side of the track portion, the guiding surfaces angled downward and away from the track portion at a non-normal angle relative to a top of the track portion that is different than an angle of sides of the tray portion such that a string sliding along either one of the guiding surfaces toward the track portion crosses over the track portion at a height corresponding with an opening defined within the bead.

2. The device as recited in claim 1, wherein the track portion includes a bottom surface disposed at a depth from the top of the guiding surfaces, the depth defining the position of the opening of the bead relative to the guiding surfaces.

3. The device as recited in claim 2, wherein the bottom surface includes a profile that aligns the bead opening transverse with a longitudinal length of the track portion.

4. The device as recited in claim 3, wherein each of the beads includes a bead width and a bead outer diameter, wherein the width is less than the outer diameter and the track includes a track width that corresponds to the bead width and is less than the bead outer diameter.

5. The device as recited in claim 1, wherein the track portion is angled downwardly away from the tray portion such that beads move toward an end of the track portion.

6. The device as recited in claim 1, wherein the both the tray portion and the entire track portion are disposed at a common angle to move beads from the tray portion into the track portion.

* * * * *